US006207041B1

(12) United States Patent
Morel et al.

(10) Patent No.: US 6,207,041 B1
(45) Date of Patent: Mar. 27, 2001

(54) PROCESS FOR CONVERTING HEAVY CRUDE OIL FRACTIONS, COMPRISING AN EBULLATING BED HYDROCONVERSION STEP AND A HYDROTREATMENT STEP

(75) Inventors: Frédéric Morel, Francheville; Pierre-Henri Bigeard, Vienne; Stéphane Kressmann, Serezin du Rhone; Didier Duee, Eragny; Jean-Luc Duplan, Irigny, all of (FR)

(73) Assignee: Institut Francais Du Petrole, Rueil-Malmaison (FR)

( * ) Notice: Subject to any disclaimer, the term of this patent is extended or adjusted under 35 U.S.C. 154(b) by 0 days.

(21) Appl. No.: 09/172,304

(22) Filed: Oct. 14, 1998

(30) Foreign Application Priority Data

Oct. 14, 1997 (FR) ..... 97 13010

(51) Int. Cl.[7] ..... C10G 45/00
(52) U.S. Cl. ..... 208/89; 208/58; 208/210
(58) Field of Search ..... 208/89, 59

(56) References Cited

U.S. PATENT DOCUMENTS

| | | | | |
|---|---|---|---|---|
| 3,905,892 | * | 9/1975 | Gregoli et al. | 208/89 |
| 4,102,779 | | 7/1978 | Hensley, Jr. | 208/211 |
| 4,344,840 | | 8/1982 | Kunesh | 208/59 |
| 4,591,426 | * | 5/1986 | Krasuk et al. | 208/96 |
| 6,007,703 | * | 12/1999 | Morel et al. | 208/210 |

FOREIGN PATENT DOCUMENTS

| | | |
|---|---|---|
| 2 042 184 | 3/1971 | (DE) . |
| 25 09 549 | 9/1975 | (DE) . |
| 2 753 984 | 4/1998 | (FR) . |

* cited by examiner

*Primary Examiner*—Helane Myers
(74) *Attorney, Agent, or Firm*—Millen White Zelano and Branigan

(57) ABSTRACT

A process for converting a hydrocarbon fraction includes a step a) for treating a hydrocarbon feed in the presence of hydrogen in at least on three-phase reactor, containing at least one hydroconversion catalyst in an ebullated bed, operating in riser mode of liquid and of gas, the reactor including at least one means located close to the bottom of the reactor for extracting catalyst from the reactor and at least one means located close to the top of the reactor for adding fresh catalyst to the reactor, a step b) for treating at least a portion of the effluent from step a) in the presence of hydrogen in at least one reactor containing at least one hydrotreatment catalyst in a fixed bed under conditions for producing an effluent with a reduced sulphur content, and a step c) in which at least a portion of the product from step b) is sent to a distillation zone from which a gaseous fraction, a gasoline type engine fuel fraction, a diesel type engine fuel fraction and a liquid fraction which is heavier than the diesel type fraction are recovered. The process can also include a step d) for catalytic cracking of the heavy fraction obtained from step c).

29 Claims, 4 Drawing Sheets

Figure 1:
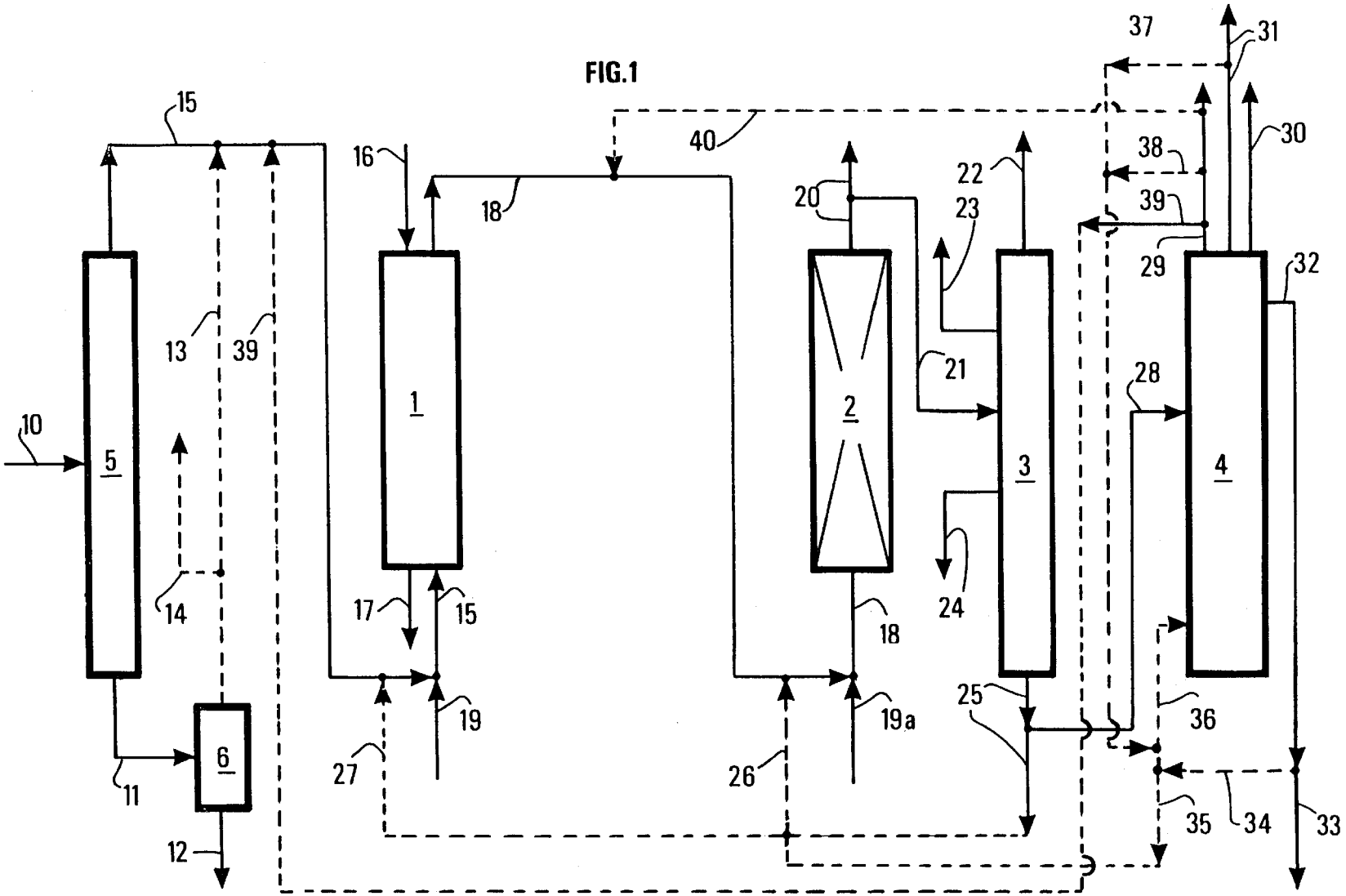

PROCESS FOR CONVERTING HEAVY CRUDE OIL FRACTIONS, COMPRISING AN EBULLATING BED HYDROCONVERSION STEP AND A HYDROTREATMENT STEP

FIELD OF THE INVENTION

The present invention relates to refining and converting heavy fractions of hydrocarbon distillates containing sulphur-containing impurities, inter alia. More particularly, it relates to a process for converting at least a portion of a hydrocarbon feed, for example a vacuum distillate obtained by straight-run distillation of a crude oil into good quality light gasoline and diesel fractions and into a heavier product which can be used as a feed for catalytic cracking in a conventional fluidised bed catalytic cracking unit and/or in a fluidised bed catalytic cracking unit comprising a double regeneration system and possibly a system for cooling the catalyst at the regeneration stage. In one aspect, the present invention also relates to a process for the production of gasoline and/or diesel comprising at least one fluidised bed catalytic cracking step.

BACKGROUND OF THE INVENTION

The prior art, in particular U.S. Pat. Nos. 4,344,840 and 4,457,829, describes processes for treating heavy hydrocarbon cuts comprising a first treatment step carried out in the presence of hydrogen in a reactor containing an ebullated bed of catalyst followed by a second step of fixed bed hydrotreatment. The descriptions illustrate the case of fixed bed treatment in the second step of a light gas fraction of the product from the first step.

One of the aims of the present invention is to produce, from certain particular hydrocarbon fractions which will be defined in the following description, by means of partial conversion of those fractions, lighter fractions which can easily be upgraded such as middle distillates (engine fuels: gasoline and diesel) and base oils.

Within the context of the present invention, the degree of conversion of the feed into lighter fractions is normally in the range 10% to 75%, or even 100% when the unconverted heavy fraction is recycled, and is usually in the range 25% to 60%, or even limited to 50%.

The feeds treated in the present invention are straight run vacuum distillates, vacuum distillates from a conversion process such as those from coking, from fixed bed hydroconversion such as those from HYVAHL® processes for treating heavy fractions developed by the Applicant, or from ebullating bed heavy fraction hydrotreatment processes such as those from H-OIL® processes, or from solvent deasphalted oils, for example propane, butane or pentane deasphalted oils originating from deasphalting a straight run vacuum residue or vacuum residues from HYVAHL® or H-OIL® processes. The feeds can also be formed by mixing those various fractions in any proportions, in particular deasphalted oil and vacuum distillate. They can also contain light cycle oil (LCO) of various origins, high cycle oil (HCO) of various origins and diesels from catalytic cracking generally having a distillation range of about 150° C. to about 370° C. They can also contain aromatic extracts and paraffins obtained from the manufacture of lubricating oils.

The aim of the present invention is to produce good quality products in particular with a low sulphur content under relatively low pressure conditions, to limit the necessary investment costs. This process can produce a gasoline type engine fuel containing less than 100 ppm by weight of sulphur thus satisfying the most severe specifications as regards sulphur content for this type of fuel, and this can be achieved using a feed which may contain more than 3% by weight of sulphur. Similarly, and this is particularly important, a diesel type engine fuel is obtained with a sulphur content much lower than 500 ppm and a residue with an initial boiling point which is, for example, about 370° C. which can be sent as a feed or part of a feed to a conventional catalytic cracking step or to a residue catalytic cracking reactor such as a double regeneration reactor, preferably to a conventional catalytic cracking reactor.

We have now discovered, and this constitutes one of the aims of the present invention, that it is possible in the second step to treat either the whole of the product from the first ebullating bed conversion step, or the liquid fraction from that step, recovering the gas fraction converted in that first step, under favourable conditions leading to good stability of the ensemble of the system and improved selectivity for middle distillate.

In its broadest aspect, the present invention is defined as a process for converting a hydrocarbon fraction with a sulphur content of at least 0.3%, normally at least 1% and usually at least 2% by weight and with an initial boiling point of at least 300° C., normally at least 340° C. and usually at least 360° C., and an end point of at least 400° C., normally at least 450° C. and which may reach 600° C. or even 700° C., characterized in that it comprises the following steps:

a) treating the hydrocarbon feed in a treatment section in the presence of hydrogen, said section comprising at least one three-phase reactor, containing at least one ebullating bed of hydroconversion catalyst the mineral support of which is at least partially amorphous, functioning in riser mode for liquid and for gas, said reactor comprising at least one means (5) located near the bottom of the reactor for extracting catalyst from said reactor and at least one means (4) located near the top of said reactor for adding fresh catalyst to said reactor;

b) sending at least a portion, normally all, of the effluent from step a) to a section for treatment in the presence of hydrogen, said section comprising at least one reactor containing at least one fixed bed of hydrotreatment catalyst the mineral support of which is at least partially amorphous, under conditions for producing an effluent with a reduced sulphur content and a higher middle distillates content.

Normally, the treatment section of step a) comprises one to three reactors in series and the treatment section of step b) also comprises one to three reactors in series.

In a preferred implementation of the invention, at least a portion, normally all, of the effluent obtained from step b) is sent to a distillation zone [step c)] from which a gas fraction, a gasoline type engine fuel fraction, a diesel type engine fuel fraction and a liquid fraction which is heavier than the diesel type fraction are recovered.

In a variation, the heavier liquid fraction of the hydroconverted feed from step c) is sent to a catalytic cracking section ]step d)] in which it is treated under conditions for producing a gas fraction, a gasoline fraction, a diesel fraction and a slurry fraction.

In a further variation, at least a portion of the heavier fraction of the hydroconverted feed from step c) is sent either to ebullated bed hydroconversion step a), or to fixed bed hydrotreatment step b), or to each of these steps. It is also possible to recycle all of that fraction.

The gas fraction obtained in steps c) or d) normally principally comprises saturated and unsaturated hydrocarbons containing 1 to 4 carbon atoms per molecule (for example methane, ethane, propane, butane, ethylene, propylene, butylenes). At least a portion, preferably all, of the gasoline type fraction obtained in step c) is sent to the gasoline pool, for example. At least a portion, preferably all, of the diesel type fraction obtained in step c) is sent to the gasoline pool. At least a portion, preferably all, of the slurry fraction obtained from step d) is usually sent to the heavy fuel pool of the refinery, generally after separating out fine particles which it contains in suspension. In a further implementation of the invention, at least a portion, preferably all, of this slurry fraction is returned to the inlet to catalytic cracking step d). In a still further implementation of the invention, at least a portion of this slurry fraction is sent either to step a), or to step b), or to each of these steps, generally after separating out the fine particles it contains in suspension.

One particular implementation of the present invention comprises an intermediate step a1) between step a) and step b) in which the product from step a) is split into a heavy liquid fraction and a lighter fraction which is recovered. In this implementation of the present invention, the heavy liquid fraction obtained in step a1) is then sent to hydrotreatment step b). This implementation improves upgrading of the light fractions obtained from hydrotreatment step a) and limits the quantity of product to be treated in step b). The lighter fraction obtained in step a1) can be sent to a distillation zone from which a gas fraction, a gasoline type engine fuel fraction, a diesel type engine fuel fraction and a liquid fraction which is heavier than the diesel fraction are recovered at least part of which can, for example, be returned to step a) and/or at least part of which can be returned to converting hydrotreatment step b). The distillation zone in which this lighter fraction is split can be distinct from the distillation zone of step c), but usually this lighter fraction is sent to the distillation zone of step c).

In a particular implementation, which may be a preferred implementation when the catalyst used in step a) tends to form fines which can eventually alter the operation of the fixed bed reactor of step b), it is possible to provide a separation step b1) to eliminate at least a portion of the fines before introducing the product from either step a) or step al) into hydrotreatment step b). This separation can be carried out using any means which is known to the skilled person. As an example, separation can be carried out using at least one centrifuging system such as a hydrocyclone, or at least one filter. The scope of the present invention encompasses direct separation of the product from step a) then sending the product which is depleted in fines to step al), but this would involve treating a larger quantity of product than if separation were to be carried out on the liquid fraction from step al) when it exists. In a particular implementation of step b1), at least two separation means are used in parallel, one being used to carry out separation while the other is purged of retained fines.

The conditions of step a) for treating the feed in the presence of hydrogen are normally the conventional ebullating bed conditions for hydroconversion of a liquid hydrocarbon fraction. An absolute pressure of 2 to 35 MPa, normally 5 to 20 MPa and usually 6 to 10 MPa is used with a temperature of about 300° C. to about 550° C., normally about 350° C. to about 500° C. The hourly space velocity (HSV) and partial pressure of hydrogen are important factors which are selected depending on the characteristics of the product to be treated and the desired conversion. The HSV is usually in a range of about 0.1 $h^{-1}$ to about 10 $h^{-1}$, preferably about 0.5 $h^{-1}$ to about 5 $h^{-1}$. The quantity of hydrogen mixed with the feed is usually about 50 to about 5000 normal cubic metres ($Nm^3$) per cubic metre ($m^3$) of liquid feed, usually about 100 to about 1000 $Nm^3/m^3$, preferably about 300 to about 500 $Nm^3/m^3$. A conventional granular hydroconversion catalyst may be used which comprises at least one metal or metal compound with a hydrodehydrogenating function on an amorphous support. This catalyst may be a catalyst comprising group VIII metals, for example nickel and/or cobalt, usually combined with at least one group VIB metal, for example molybdenum and/or tungsten. A catalyst may be used which, for example, comprises 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) on an amorphous mineral support. The support can, for example, be selected from the group formed by alumina, silica, silica-aluminas, magnesia, clays and mixtures of at least two of these minerals. The support can also comprise other compounds, for example oxides selected from the group formed by boron oxide, zirconia, titanium oxide, and phosphoric anhydride. Usually, an alumina support is used, mainly an alumina support doped with phosphorous and possibly with boron. The concentration of phosphoric anhydride $P_2O_5$ is normally less than about 20% by weight, usually less than about 10% by weight. This $P_2O_5$ concentration is normally at least 0.001% by weight. The concentration of boron trioxide $B_2O_3$ is normally about 0 to about 10% by weight. The alumina used is normally a $\gamma$ or a $\eta$ alumina. This catalyst is usually in the form of extrudates. The total concentration of oxides of group VIB and VIII metals is normally about 5% to about 40% by weight, generally about 7% to 30% by weight, and the weight ratio of the group VIB metal(s) to the group VIII metal(s), expressed as the metal oxide, is generally about 20 to about 1, usually about 10 to about 2. Used catalyst is partially replaced by fresh or new catalyst at regular intervals for example, in batches or quasi-continuously by extracting it from the bottom of the reactor. Fresh catalyst can be introduced every day, for example. The rate of replacing used catalyst with fresh catalyst can, for example, be about 0.05 kilograms to about 10 kilograms per cubic metre of feed. Extraction and replacement are carried out using apparatus which enable this hydroconversion step to be carried out continuously. The unit normally comprises a recirculation pump which maintains the catalyst in an ebullating bed by continuously recycling at least a portion of the liquid extracted from the head of the reactor and re-injecting it at the bottom of the reactor. It is also possible to send used catalyst extracted from the reactor to a regeneration zone in which the carbon and sulphur contained in the catalyst are eliminated, then to send the regenerated catalyst to hydroconversion step a).

Usually, this hydroconversion step a) is carried out under T-STAR® process conditions as described, for example, in the article "Heavy Oil Hydroprocessing", published by l'Aiche, Mar. 19–23, 1995, HOUSTON, Tex., paper number 42*d*. It can also be carried out under the conditions of the H-OIL® process as described, for example, in the article published by NPRA Annual Meeting, Mar. 16–18, 1997, J. J. Colyar and L. I. Wilson, entitled "THE H-OIL® PROCESS: A WORLDWIDE LEADER IN VACUUM RESIDUE HYDROPROCESSING".

The products obtained during step a) in the variation mentioned above [step a1)] are sent to a separation zone from which a heavy liquid fraction and a lighter fraction can be recovered. This heavy liquid fraction normally has an initial boiling point of about 350° C. to about 400° C., preferably about 360° C. to about 380° C., for example about 370° C. The lighter fraction is normally sent to a separation zone in which it is split into light gasoline and diesel fractions at least part of which can be sent to gasoline pools, and into a heavier fraction.

In hydrotreatment step b), a conventional hydrotreatment catalyst is normally used, preferably at least one of those which have been described by the Applicant, in particular one of the catalysts described in European patents EP-B-0 113 297 and EP-B-0 113 284. An absolute pressure of about 2.5 to 35 MPa is normally used, usually about 5 to 20 MPa and more usually about 6 to 10 MPa. The temperature in step b) is normally about 300° C. to about 500° C., usually about 350° C. to about 450° C., and more usually about 350° C. to about 420° C. This temperature is normally adjusted depending on the desired level of hydrodesulphuration. The hourly space velocity (HSV) and partial pressure of hydrogen are important factors which are selected depending on the characteristics of the product to be treated and the desired conversion. The HSV is usually in a range of about 0.1 $h^{-1}$ to about 5 $h^{-1}$, preferably about 0.5 $h^{-1}$ to about 2 $h^{-1}$. The quantity of hydrogen mixed with the feed is normally about 100 to about 5000 normal cubic metres ($Nm^3$) per cubic metre ($m^3$) of liquid feed, usually about 200 to about 1000 $Nm^3/m^3$, and preferably about 300 to about 500 $Nm^3/m^3$. The operation is preferably carried out in the presence of hydrogen sulphide and the partial pressure of hydrogen sulphide is normally about 0.002 times to about 0.1 times, preferably about 0.005 times to about 0.05 times, the total pressure. In the hydrodesulphuration zone, the ideal catalyst must have a high hydrogenating power, so as to carry out thorough refining of the products, and to obtain a large reduction in sulphur. In the preferred implementation, the hydrotreatment zone operates at a relatively low temperature, which tends towards thorough hydrogenation and limits to coking. The scope of the present invention encompasses using a single catalyst or several different catalysts in the hydrotreatment zone, either simultaneously or successively. This step b) is normally carried out on an industrial scale in one or more reactors with a downflow of liquid.

In the hydrotreatment zone [step b)], at least one fixed bed of conventional hydrotreatment catalyst is used, the support of which is preferably at least partially amorphous. Preferably, a catalyst is used the support of which is, for example, selected from the group formed by alumina, silica, silica-aluminas, magnesia, silicamagnesias, clays and mixtures of at least two of these minerals. The support can also comprise other compounds, for example oxides selected from the group formed by boron oxide, zirconia, titanium oxide and phosphoric anhydride. Normally, an alumina support is used, usually an alumina support doped with phosphorous and possibly boron. The concentration of phosphoric anhydride $P_2O_5$ is normally less than about 20% by weight, usually less than about 10% by weight. This $P_2O_5$ concentration is normally at least 0.001% by weight. The concentration of boron trioxide $B_2O_3$ is normally about 0 to about 10% by weight. The alumina used in normally a $\gamma$ or a $\eta$ alumina. This catalyst is usually in the form of extrudates or beads. A conventional granular hydrotreatment catalyst can be used which comprises at least one metal or metal compound having a hydro-dehydrogenating function, on an amorphous support. This catalyst can be a catalyst comprising group VIII metals, for example nickel and/or cobalt, usually combined with at least one group VIB metal, for example molybdenum and/or tungsten. As an example, a catalyst can be used which comprises 0.5% to 10% by weight of nickel, preferably 1% to 5% by weight of nickel (expressed as nickel oxide NiO), and 1% to 30% by weight of molybdenum, preferably 5% to 20% by weight of molybdenum (expressed as molybdenum oxide $MoO_3$), on an amorphous mineral support. The total content of group VI and VIII metal oxides is usually about 5% to about 40% by weight, in general about 7% to 30% by weight, and the weight ratio, expressed as the metal oxide, between the group VIB metal (or metals) and the group VIII metal (or metals) is generally about 20 to about 1, usually about 10 to about 2.

In the distillation zone of step c), the conditions are generally selected so that the cut point for the heavy feed is about 350° C. to about 400° C., preferably about 360° C. to about 380° C., for example about 370° C. In this distillation zone, a gasoline fraction with an end point which is usually about 150° C. and a diesel fraction with an initial boiling point which is usually about 150° C. and an end point of about 370° C. are recovered.

Finally, in a variation mentioned above, in a catalytic cracking step d) at least a portion of the heavy fraction of the hydrotreated feed obtained in step c) can be sent to a conventional catalytic cracking section in which it is conventionally catalytically cracked under conditions which are well known to the skilled person to produce a fuel fraction (comprising a gasoline fraction and a diesel fraction) at least a portion of which is normally sent to gasoline pools, and a slurry fraction at least a portion, preferably all, of which is sent to a heavy fuel pool, for example, or at least a portion, preferably all, of which is recycled to catalytic cracking step d). Within the context of the present invention, the expression "conventional catalytic cracking" encompasses cracking processes comprising at least one partial combustion regeneration step and those comprising at least one total combustion regeneration step and/or those comprising both at least one partial combustion step and at least one total combustion step. In a particular implementation of the invention, a portion of the diesel fraction obtained during this step d) is recycled either to step a), or to step b) or to step d) mixed with the feed introduced into catalytic cracking step d). In the present description the term "a portion of the diesel fraction" means a fraction of less than 100%. The scope of the present invention encompasses recycling a portion of the diesel fraction to step a), a portion to step b) and a further portion to step d), the ensemble of these portions not necessarily adding up to the whole of the diesel fraction. It is also possible to recycle all of the diesel obtained by catalytic cracking either to step a), or to step b) or to step d), or a fraction to each of these steps, the sum of the fractions representing 100% of the diesel fraction obtained in step d). At least a portion of the gasoline fraction obtained in catalytic cracking step d) can also be recycled to step d).

A summary description of catalytic cracking (the first industrial use goes back to 1936 (HOUDRY process) or to 1942 for the use of a fluidised bed of catalyst) will be found in ULLMANS ENCYCLOPEDIA OF INDUSTRIAL CHEMISTRY VOLUME A 18, 1991, pages 61 to 64. A conventional catalyst is normally used, comprising a matrix, an optional additive, and at least one zeolite. The quantity of zeolite is variable but is normally about 3% to 60% by weight, usually about 6% to 50% by weight and more usually about 10% to 45% by weight. The zeolite is normally dispersed in the matrix. The quantity of additive is normally about 0 to 30% by weight, usually about 0 to 20% by weight. The quantity of matrix represents the complement to 100% by weight. The additive is generally selected from the group formed by oxides of metals from group IIA of the periodic table such as magnesium oxide or calcium oxide, rare earth oxides and titanates of group IIA metals. The matrix is usually a silica, an alumina, a silica-alumina, a silica-magnesia, a clay or a mixture of two or more of these products. The most frequently used zeolite is Y zeolite. Cracking is carried out in a substantially vertical reactor either in riser or in dropper mode. The choice of catalyst and the operating conditions are functions of the desired products depending on the feed treated as described, for example, in the article by M. MARCILLY, pages 990–991, published in the Institut Français du Pétrole review, November–December 1975, pages 969–1006. The temperature is normally about 450° C. to about 600° C. and the residence times in the reactor are less than 1 minute, usually about 0.1 to about 50 seconds.

The catalytic cracking step d) can also be a fluidised bed catalytic cracking step, for example using the process known as R2R developed by the Applicants. This step can be carried out in conventional fashion as known to the skilled person under conditions suitable for cracking with a view of producing lower molecular weight hydrocarbon products. Descriptions of the operation and catalysts for use in this context of fluidised bed cracking in this step d) are described, for example, in patents U.S. Pat. No. 4,695,370, EP-B-0 184 517, U.S. Pat. No. 4,959,334, EP-B-0 323 297, U.S. Pat. Nos. 4,965,232, 5,120,691, 5,344,554, 5,449,496, EP-A-0 485 259, U.S. Pat. Nos. 5,286,690, 5,324,696 and EP-A-0 699 224, the descriptions of which are hereby incorporated into the present description by reference.

The fluidised bed catalytic cracking reactor can operate in riser or dropper mode. Although it is not a preferred implementation of the present invention, it is also possible to carry out catalytic cracking in a moving bed reactor. Particularly preferred catalytic cracking catalysts are those containing at least one zeolite normally mixed with a suitable matrix such as alumina, silica, or silica-alumina.

In a particular implementation, when the treated feed is a vacuum distillate from vacuum distillation of an atmospheric distillation residue of a crude oil it is advantageous to recover the vacuum residue to send it to a solvent deasphalting step f) from which an asphalt fraction is recovered and a deasphalted oil is recovered at least part of which, for example, is sent to hydroconversion step a) mixed with the vacuum distillate. In this particular implementation, at least a portion of the slurry fraction obtained in catalytic cracking step d) can advantageously be recycled to the inlet to this deasphalting step f)

Solvent deasphalting step f) is carried out under conventional conditions which are well known to the skilled person. Reference should be made in this respect to the article by BILLON et al published in 1994 in volume 49, number 5 of the Institut Français du Pétrole review, pages 495 to 507, or to the description given in the description in French patent FR-B-2 480 773, or to the description in the Applicant's patent FR-B-2 681 871, or to the description of our patent U.S. Pat. No. 4,715,946, the descriptions of which are hereby incorporated by reference. Deasphalting is normally carried out at a temperature of 60° C. to 250° C. with at least one hydrocarbon solvent containing 3 to 7 carbon atoms, possibly with the addition of at least one additive. Suitable solvents and additives have been widely described in the documents cited above and in patent documents U.S. Pat. Nos. 1,948,296, 2,081,473, 2,587,643, 2,882,219, 3,278,415 and 3,331,394, for example. It is also possible to recover solvent using an opticritical process, i.e., using a solvent under supercritical conditions. This process can in particular substantially improve the overall economics of the process. Deasphalting can be carried out in a mixer-settler or in an extraction column. In the context of the present invention, a technique using at least one extraction column is preferred.

In a preferred implementation of the invention, the residual asphalt obtained from step f) is sent to an oxyvapogasification section in which is transformed into a gas containing hydrogen and carbon monoxide. This gas mixture can be used to synthesise methanol or to synthesise hydrocarbons using the Fischer-Tropsch reaction. In the context of the present invention, this mixture is preferably sent to a shift conversion section in which it is converted to hydrogen and carbon dioxide in the presence of steam. The hydrogen obtained can be used in steps a) and b) of the process of the invention. The residual asphalt can also be used as a solid fuel or, after fluxing, as a liquid fuel, or it can form part of a bitumen composition.

FIGS. 1, 2, 3 and 4 schematically represent the principal variations for implementing the process of the invention. In the Figures, similar items are designated by the same reference numbers and letters.

In FIG. 1, the hydrocarbon feed to be treated enters via line 10 into vacuum distillation zone (5) at the outlet from which a vacuum distillate is recovered via line 15 and a vacuum residue is recovered via line 11 which is sent to a solvent deasphalting zone (6) from which an asphalt is recovered via line 12 and a deasphalted oil is recovered via line 14 and optionally sent via line 13 to the vacuum distillate which leaves the distillation zone via line 15, which distillate is sent to a section (1) for treatment in the presence of hydrogen, said hydrogen being introduced via line 19. Catalyst is added via line 16 and extracted via line 17. The effluent treated in zone (1) is sent via line 18 to a zone (2) for hydrotreatment in the presence of hydrogen (introduced via line 19*a*); a portion of the treated effluent is optionally recovered via line 20 and a portion is sent via line 21 to a distillation zone from the outlet of which a gas fraction is recovered via line 22, a gasoline fraction is recovered via line 24 and a diesel fraction and a liquid fraction which is heavier than the diesel type fraction via line 25 which is optionally sent to hydrotreatment section (2) via line 26 and optionally to hydrotreatment section (1) via line 27, and is sent to a catalytic cracking section (4) via line 28, at the outlet from which a gas fraction is recovered via line 30, a gasoline fraction is recovered via line 31, a diesel fraction is recovered via line 29 and a slurry fraction is recovered via line 32, part of which is sent to the heavy fuel pool via line 33, a further portion of the slurry fraction optionally being sent via line 34 then via line 36 to the catalytic cracking section (4), a further portion of the slurry fraction optionally being sent via line 35, then via line 26 to the hydrotreatment section (2). A portion of the gasoline fraction is optionally sent via line 37 and line 36 to the catalytic cracking zone (4). A portion of the diesel fraction is optionally sent via line 38 then via line 36 to the catalytic cracking zone (4), a further portion of that fraction optionally being sent via line 39 to the hydrotreatment section (1), a further portion of that same fraction optionally being sent via line 40 to the hydrotreatment section (2).

Figure 2:
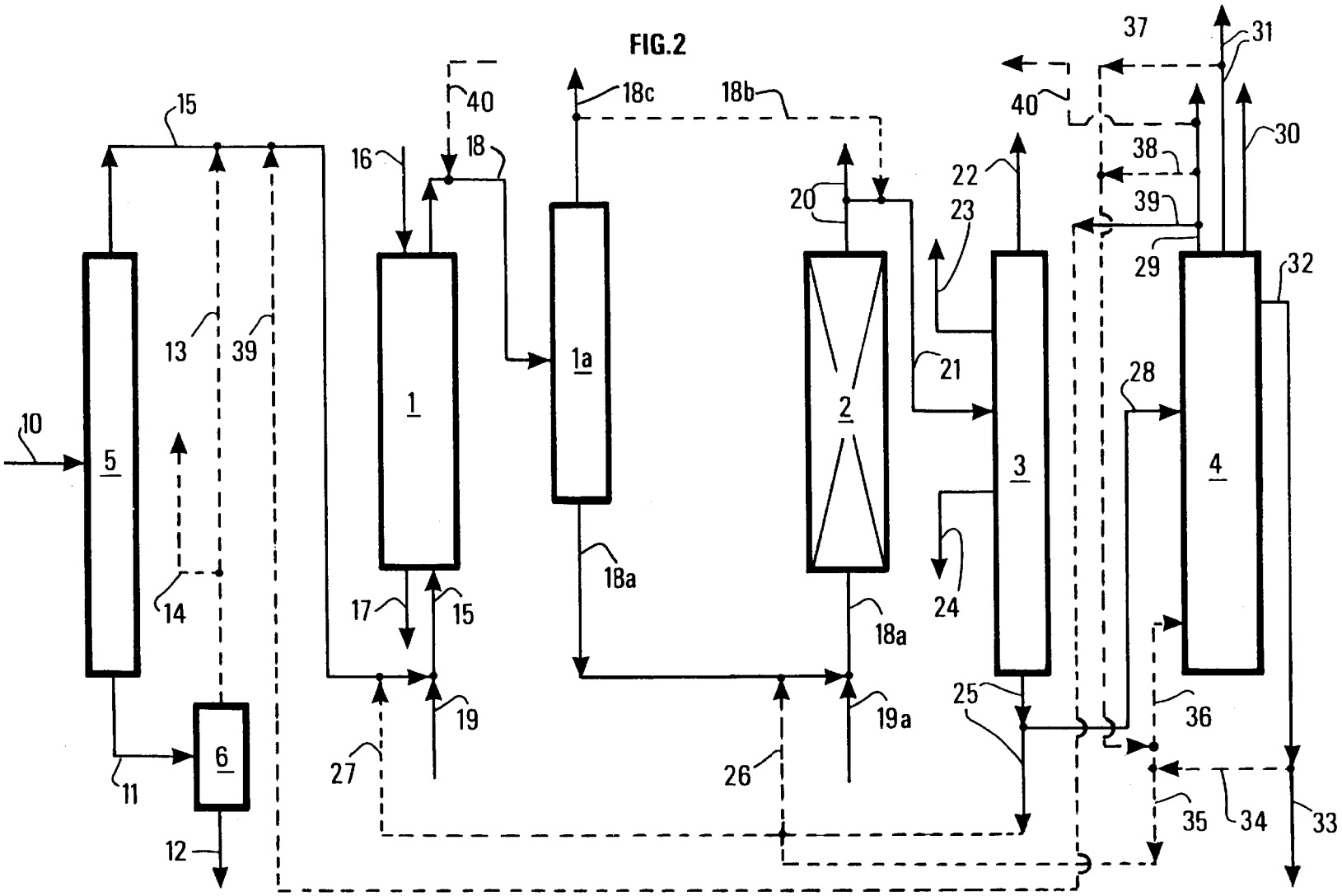

In a particular embodiment of the invention described in FIG. 2, the effluent recovered via line 18 after treatment in section (1) is sent to a zone (1*a*) in which the effluent is split into a heavy fraction which is sent to hydrotreatment section (2) via line 18*a* and into a light fraction which is recovered via line 18*c*, a portion of that light fraction optionally being sent via line 18*b* to a distillation zone (3).

Figure 3:
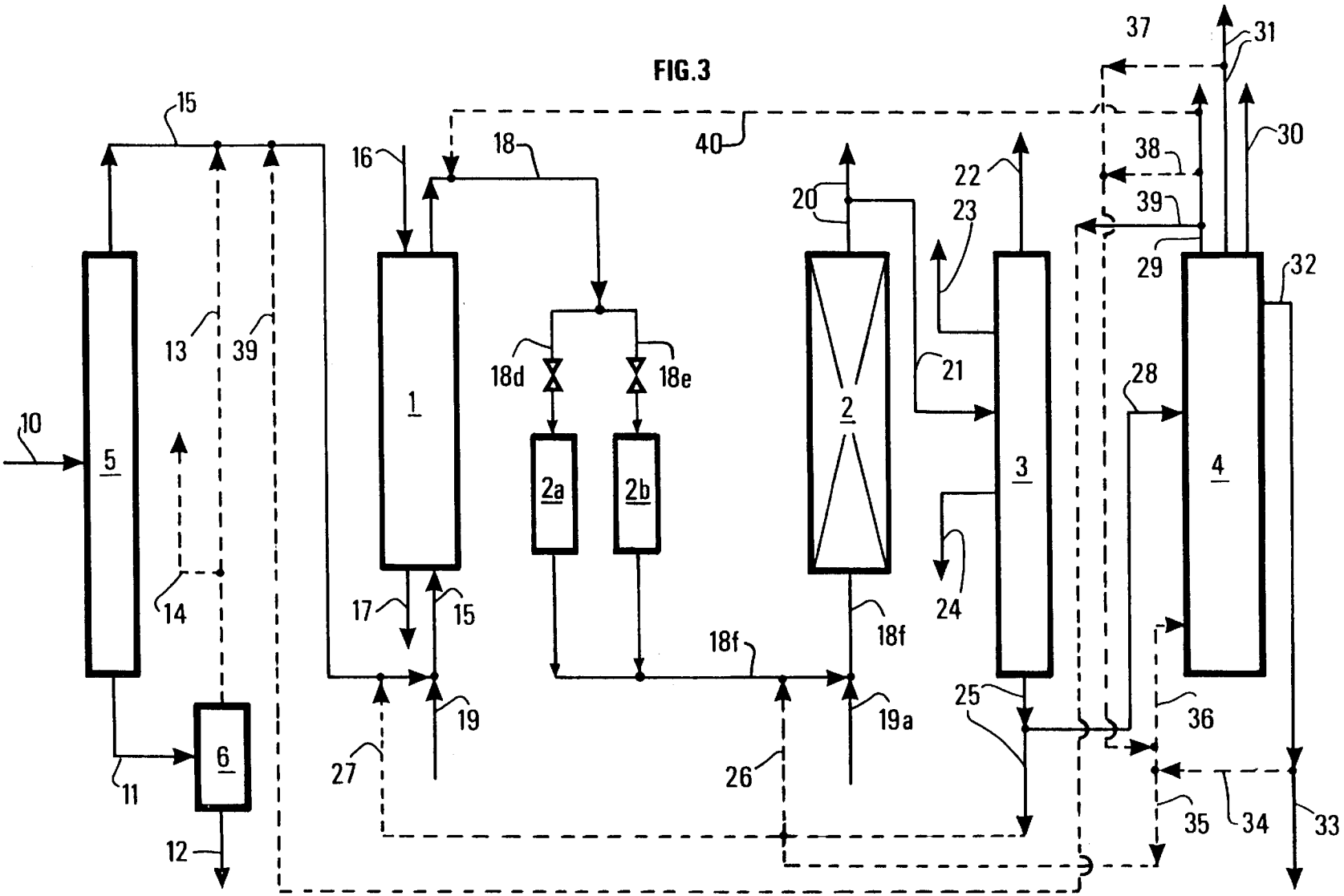

In a further particular embodiment of the invention described in FIG. 3, the effluent recovered via line 18 after treatment in section (1) is sent via lines 18*d* and 18*e* to zones (2*a*) and (2*b*) for separating fines from which an effluent is recovered via line 18*f* which is sent to the hydrotreatment section (2).

Figure 4:
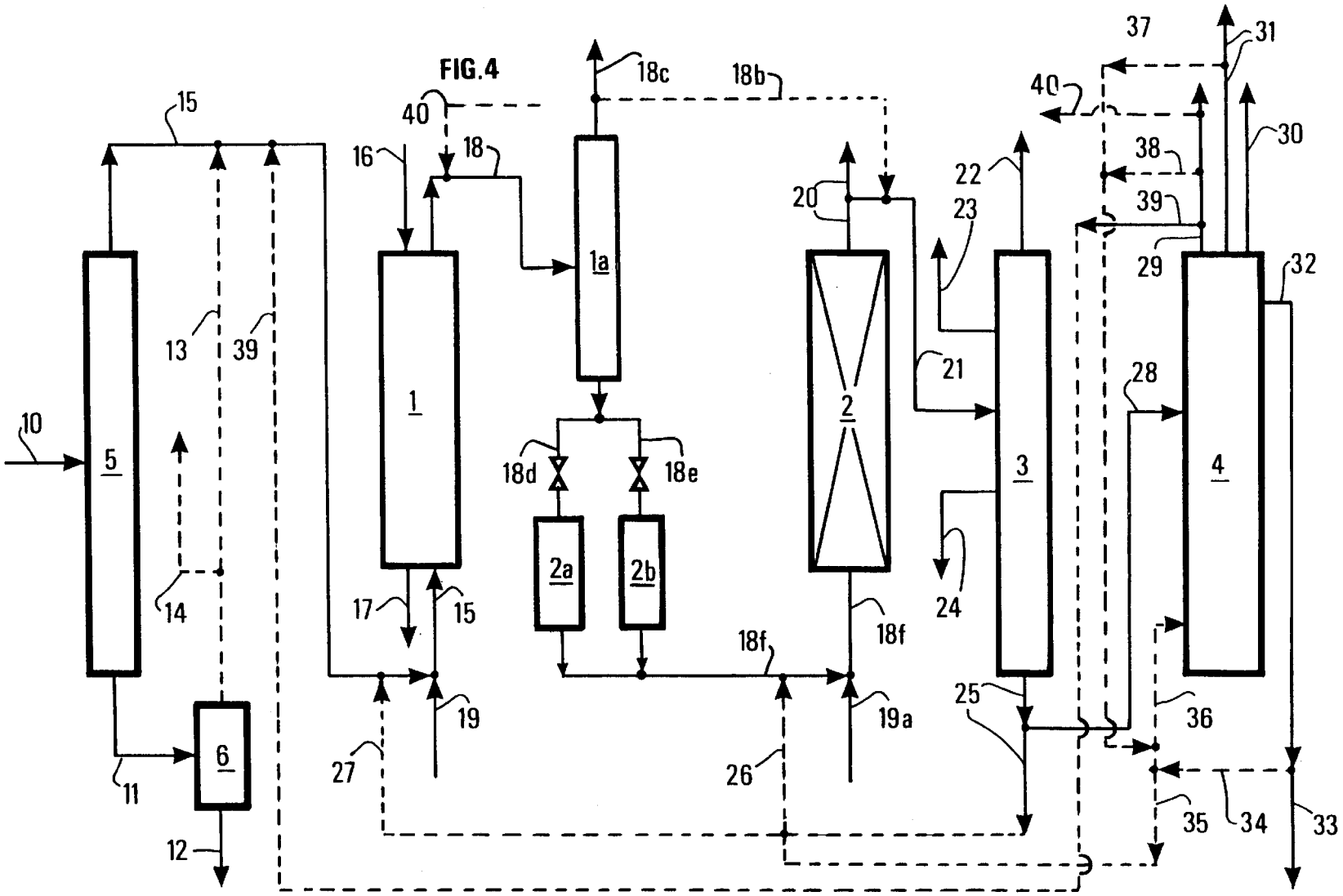

In the still further particular embodiment of the invention described in FIG. 4, the effluent recovered via line 18 after treatment in section (1) is sent to a zone (1*a*) in which said effluent is split into a heavy liquid fraction which is sent via lines 18*d* and 18*e* to zones (2*a*) and (2*b*) for separating fines from which an effluent is recovered which is sent to hydrotreatment section (2) via line 18*f*, and into a light fraction which is recovered via line 18*c*, a portion of that light fraction optionally being sent to distillation zone (3) via line 18*b*.

EXAMPLES

These examples result from experiments carried out in pilot units.

Examples 1 (Comparative)

A heavy vacuum distillate (VD) from Safaniya was treated. Its characteristics are shown in column 1 of Table 1. The yields were calculated using the weight of VD as 100.

The Safaniya vacuum distillate was treated in a pilot unit comprising a reactor with a fixed bed of catalyst.

The reactor simulated the reactor in an industrial unit for hydrotreatment of a vacuum distillate in a fixed bed. The fluids were in upflow mode in the reactor, in contrast to the industrial unit. It has been verified elsewhere that this mode of operating a pilot unit provides equivalent results to those of industrial units operating in fluid downflow mode.

1 liter of commercially available catalyst sold by PROCATALYSE, reference number HR348, was placed in the fixed bed reactor.

The operating conditions were as follows:

overall HSV: 1.5 $h^{-1}$;

pressure: 75 bars (7.5 MPa);

hydrogen recycle: 400 liters of hydrogen per litre of feed;

temperature in the reactor: 375° C.

The liquid products from the reactor were fractionated in the laboratory into a gasoline fraction (IP 150° C.), a diesel fraction (150–370° C.) and a residual fraction ($370^{+}$° C.).

Table 2 shows the yields and the principal characteristics of the products obtained: gasoline and diesel.

Column 2 of Table 1 gives the characteristics of the residual fraction $370^{+}$° C., which formed the feed which is sent to the catalytic cracking pilot unit which used a catalyst containing 20% by weight of Y zeolite and 80% by weight of a silica-alumina matrix. This feed, pre-heated to 135° C., was brought into contact at the bottom of a vertical pilot reactor with a hot regenerated catalyst from a pilot regenerator. The temperature of the catalyst at the reactor inlet was 725° C. The ratio of the flow rate of the catalyst to the flow rate of the feed was 6.1. The added heat provided by the catalyst at 725° C. vaporised the feed and enabled the endothermic cracking reaction to occur. The average residence time of the catalyst in the reaction zone was about 3 seconds. The operating pressure was 1.8 bars absolute. The temperature of the catalyst measured at the outlet from the riser was 515° C. The cracked hydrocarbons and the catalyst were separated by means of cyclones located in a stripper zone where the catalyst was stripped. The catalyst, which had become coked during the reaction and had been stripped in the stripper zone, was then sent to the regenerator. The amount of coke in the solid (delta coke) at the regenerator inlet was 0.9%. This coke was burned by air injected into the regenerator. The highly exothermic combustion raised the temperature of the solid from 515° C. to 725° C. The hot regenerated catalyst left the regenerator and was returned to the bottom of the reactor.

The hydrocarbons separated from the catalyst left the stripper zone; they were cooled in exchangers and sent to a stabilisation column which separated the gas and liquids. The liquid (C5+) was also sampled then fractionated in a further column to recover a gasoline fraction, a diesel fraction and a heavy fuel or slurry fraction (370° C.+). Table 3 shows the yields and principal characteristics of the products obtained.

The gasoline fraction recovered by distilling the effluent from the outlet from the fixed bed reactor was then mixed with the gasoline fraction recovered from the product from the catalytic cracking step and the same was carried out with the two diesel fractions. Table 4 shows the total yields of gasoline and diesel obtained and the principal characteristics of the products.

High yields of gasoline were observed but the diesel yields were low combined with high sulphur contents, with this process comprising only one fixed bed treatment step and a step for catalytic cracking of the heavy 370+° C. fraction, recovered at the outlet from the fixed bed reactor.

TABLE No 1

| | 1<br>VD<br>Safaniya<br>SR | 2<br>VD<br>Safaniya<br>ex HDT<br>FCC feed |
|---|---|---|
| Yield/VD, weight % | 100 | 88 |
| 15/4 density | 0.940 | 0.907 |
| Sulphur, weight % | 3.08 | 0.2 |
| Conradson carbon, weight % | 1.2 | 0.1 |
| Nitrogen, ppm | 1092 | 450 |
| Hydrogen, weight % | 11.9 | 12.9 |
| Sim. Dist, weight % | | |
| 5% | 366 | 390 |
| 50% | 488 | 470 |
| 95% | 578 | 565 |

TABLE No 2

| Ex HDT products | Gasoline<br>IP - 150 | Diesel<br>150–370 |
|---|---|---|
| Yield/VD SR, weight % | 1 | 9 |
| 15/4 density | 0.745 | 0.895 |
| Sulphur, ppm by weight | 50 | 800 |
| Nitrogen, ppm by weight | 10 | 90 |
| (RON + MON)/2 | 51 | |
| Motor cetane | | 42 |

TABLE No 3

| Ex FCC products | Gasoline<br>IP - 220 | Diesel<br>220–370 |
|---|---|---|
| Yield/FCC feed, weight % | 60 | 9.7 |
| Yield/VD SR, weight % | 52.8 | 8.5 |
| 15/4 density | 0.747 | 0.924 |
| Sulphur, ppm by weight | 90 | 2400 |
| Nitrogen, ppm by weight | 15 | 400 |
| (RON + MON)/2 | 86 | |
| Motor cetane | | 27 |

TABLE No 4

| Total products | Gasoline Total | Diesel Total |
|---|---|---|
| Yield/VD SR, weight % | 53.8 | 17.5 |
| 15/4 density | 0.747 | 0.909 |
| Sulphur, ppm by weight | 88 | 1580 |
| Nitrogen, ppm by weight | 15 | 240 |
| (RON + MON)/2 | 85 | |
| Motor cetane | | 35 |

Example 2 (In Accordance with the Invention)

The same heavy vacuum distillate (VD) from Safaniya as that used in Example 1 was treated. Its characteristics are shown in column 1 of Table 1b. All yields were calculated using the weight of VD as 100.

This Safaniya vacuum distillate was treated in a pilot unit comprising a first ebullating bed of catalyst and a second reactor with a fixed bed of catalyst.

The first reactor simulated an industrial unit for the T-STAR® process with an ebullating bed while the second reactor simulated an industrial unit for hydrotreating a vacuum distillate in a fixed bed. The fluid flow was in upflow mode in the two reactors, in contrast to an industrial unit. It has been shown elsewhere that this mode of operating in a pilot unit provides results which are equivalent to those of industrial units operating in fluid downflow mode.

Between the two reactors, a filtration system was installed to eliminate catalyst fines generated in the first reactor operating as an ebullating bed. This avoided the occurrence of pressure drops in the second reactor operating as a fixed bed, and also prevented rapid deactivation of the fluid catalytic cracking catalyst (FCC) as a result of the possible presence of molybdenum in the catalyst fines leaving the first reactor. This filtration system comprised two filters in parallel, one of which was in service while the other was standing by or being regenerated, and one was changed for the other when pressure drops occurred in the filter in service.

The first reactor contained 1 litre of a specific catalyst for T-Star manufacture produced by PROCATALYSE with reference number HTS358. 1 litre of a commercial catalyst sold by PROCATALYSE with reference number HR348, was placed in the second, fixed bed reactor.

The operating conditions were as follows:

overall HSV: 0.7 $h^{-1}$;

pressure: 75 bars (7.5 MPa);

hydrogen recycle: 400 liters of hydrogen per litre of feed; temperature in first reactor: 425° C.; temperature in second reactor: 380° C.

The liquid products from the reactor were fractionated in the laboratory into a gasoline fraction (initial point 150° C.), a diesel fraction (150–370° C.) and a residual fraction ($370^{+}$° C.).

Table 2b shows the yields and the principal characteristics of the products obtained: gasoline and diesel.

Column 2 of Table 1b shows the characteristics of the residual fraction $370^{+}$° C., which formed the feed which was sent to the catalytic cracking pilot unit which used a catalyst containing 20% by weight of Y zeolite and 80% by weight of a silica-alumina matrix. This feed, pre-heated to 135° C., was brought into contact at the bottom of a vertical pilot reactor with a hot regenerated catalyst from a pilot regenerator. The temperature of the catalyst at the reactor inlet was 720° C. The ratio of the flow rate of the catalyst to the flow rate of the feed was 6.0. The added heat provided by the catalyst at 720° C. vaporised the feed and enabled the endothermic cracking reaction to occur. The average residence time of the catalyst in the reaction zone was about 3 seconds. The operating pressure was 1.8 bars absolute. The temperature of the catalyst measured at the outlet from the riser was 525° C. The cracked hydrocarbons and the catalyst were separated by means of cyclones located in a stripper zone where the catalyst was stripped. The catalyst, which had become coked during the reaction and had been stripped in the stripper zone, was then sent to the regenerator. The amount of coke in the solid (delta coke) at the regenerator inlet was 0.85%. This coke was burned by air injected into the regenerator. The highly exothermic combustion raised the temperature of the solid from 525° C. to 720° C. The hot regenerated catalyst left the regenerator and was returned to the bottom of the reactor.

The hydrocarbons separated from the catalyst left the stripper zone; they were cooled in exchangers and sent to a stabilisation column which separated the gas and liquids. The liquid (C5+) was also sampled then fractionated in a further column to recover a gasoline fraction, a diesel fraction and a heavy fuel or slurry fraction (370° C.+). Table 3b shows the yields and principal characteristics of the products obtained.

The gasoline fraction recovered by distilling the effluent from the outlet from the second reactor was then mixed with the gasoline fraction recovered from the product from the catalytic cracking step and the same was carried out with the two diesel fractions. Table 4b shows the total yields of gasoline and diesel obtained and the principal characteristics of the products.

On comparing with Example 1, it can be seen that the diesel yields were high and the quality of the products from the process of the present invention (Example 2) was high, the process comprising a succession of an ebullating bed treatment step, a fixed bed treatment step for the total effluent leaving the reactor operating in ebullating bed mode, and a step for catalytically cracking the heavy 370+° C. fraction recovered at the outlet from the second reactor operating as a fixed bed.

TABLE No 1b

| cut | 1 VD Safaniya | 2 VD Safaniya ex T-Star + HDT FCC feed |
|---|---|---|
| Yield/VD, weight % | 100 | 45.2 |
| 15/4 density | 0.940 | 0.875 |
| Sulphur, weight % | 3.08 | 0.05 |
| Conradson carbon, weight % | 1.2 | <0.1 |
| Nitrogen, ppm | 1092 | 150 |
| Hydrogen, weight % | 11.9 | 13.1 |
| Sim. Dist, weight % | | |
| 5% | 366 | 390 |
| 50% | 488 | 460 |
| 95% | 578 | 558 |

TABLE No 2b

| Ex T-Star + HDT products | Gasoline IP - 150 | Diesel 150–370 |
|---|---|---|
| Yield/VD SR, weight % | 8.3 | 37.4 |
| 15/4 density | 0.740 | 0.853 |
| Sulphur, ppm by weight | 30 | 160 |
| Nitrogen, ppm by weight | 8 | 40 |
| (RON + MON)/2 | 55 | |
| Motor cetane | | 45 |

TABLE No 3b

| Ex FCC products | Gasoline IP - 220 | Diesel 220–370 |
|---|---|---|
| Yield/FCC feed, weight % | 61.7 | 9.7 |
| Yield/VD SR, weight % | 27.9 | 4.4 |
| 15/4 density | 0.736 | 0.924 |
| Sulphur, ppm by weight | 20 | 800 |
| Nitrogen, ppm by weight | 10 | 200 |
| (RON + MON)/2 | 86 | |
| Motor cetane | | 28 |

TABLE No 4b

| Total products | Gasoline Total | Diesel Total |
|---|---|---|
| Yield/VD SR, weight % | 36.2 | 41.8 |
| 15/4 density | 0.737 | 0.860 |
| Sulphur, ppm by weight | 23 | 229 |
| Nitrogen, ppm by weight | 9 | 57 |
| (RON + MON)/2 | 78 | |
| Motor cetane | | 43 |

What is claimed is:

1. A process for converting a hydrocarbon fraction with a sulphur content of at least 0.3%, an initial boiling point of at least 300° C., and an end point of at least 400° C., comprising:

a) treating the hydrocarbon feed in a treatment section in the presence of hydrogen, said section comprising at least one three-phase reactor, containing at least one ebullated bed of hydroconversion catalyst the mineral support of which is at least partially amorphous, functioning in riser mode for liquid and gas, a line located near the bottom and in communication with the reactor for extracting catalyst from said reactor and a line located near the top and in communication with said reactor for adding fresh catalyst to said reactor;

b) sending at least a portion of the effluent from a) to a section for treatment in the presence of hydrogen, said section comprising at least one reactor containing at least one fixed bed of hydrotreatment catalyst, the mineral support of which is at least partially amorphous, under conditions for producing an effluent with a reduced sulphur content and a higher middle distillates content.

2. The process according to claim 1, in which at least a portion of the effluent obtained from b) is sent to a distillation zone, c, from which a gas fraction, a gasoline engine fuel fraction, a diesel engine fuel fraction and a liquid fraction which is heavier than the diesel fraction are recovered.

3. The process according to claim 1, in which the liquid fraction which is heavier than the diesel fraction obtained from c) is sent to a catalytic cracking section, d, in which it is treated under conditions for recovering a gas fraction, a gasoline fraction, a diesel fraction and a slurry fraction.

4. The process according to claim 3, in which at least a portion of the diesel fraction recovered at catalytic cracking d) is recycled to a) and/or b).

5. The process according to claim 3, in which catalytic cracking d) is carried out under conditions which can produce a gasoline fraction at least a portion of which is sent to the gasoline pool, a diesel fraction at least a portion of which is sent to the diesel pool and a slurry fraction at least a portion of which is sent to the heavy fuel pool.

6. The process according to claim 3, in which at least a portion of the diesel fraction and/or the gasoline fraction obtained from catalytic cracking d) is recycled to the inlet to said d).

7. The process according to claim 3, in which at least a portion of the slurry fraction obtained at catalytic cracking d) is recycled to the inlet to said d).

8. The process according to claim 2, in which at least a portion of the liquid fraction which is heavier than the diesel fraction obtained in c) is returned either to hydroconversion a), or to hydrotreatment b), or to each of said a) and b).

9. The process according to claim 3, in which at least a portion of said slurry fraction is returned either to hydroconversion a), or to hydrotreatment b), or to each of a) and b).

10. The process according to claim 1, characterized in that it comprises a step a1) between a) and b) in which the product from a) is split into a heavy liquid fraction which is sent to hydrotreatment b) and a lighter fraction which is recovered.

11. The process according to claim 10, in which the lighter liquid fraction which is recovered is sent to a distillation zone from which a gas fraction, a gasoline engine fuel fraction, a diesel engine fuel fraction and a liquid fraction which is heavier than the diesel fraction are recovered.

12. The process according to claim 10, in which at least a portion of the liquid fraction which is heavier than the diesel fraction is returned to a) and/or returned to b).

13. The process according to claim 10, in which the lighter liquid fraction which is recovered is sent to the distillation zone of c).

14. The process according to claim 10, characterized in that it comprises a separation b1) to at least partially eliminate fines contained in the product from either a) or a1) before introducing it either into a1) or into b).

15. The process according to claim 14, in which the separation b1 comprises using two separation means in parallel, one of which is used to carry out separation while the other is purged of retained fines.

16. The process according to claim 1, in which during a), the treatment in the presence of hydrogen is carried out at an absolute pressure of 2 to 35 MPa, a temperature of about 300° C. to 550° C., an hourly space velocity of about 0.1 to 10 $h^{-1}$, and the quantity of hydrogen mixed with the feed is about 50 to 5000 $Nm^3/m^3$.

17. The process according to claim 1, in which hydrotreatment b) is carried out at an absolute pressure of 2.5 to 35 MPa, a temperature of about 300° C. to 500° C., an hourly space velocity of about 0.1 to 5 $h^{-1}$, and the quantity of hydrogen mixed with the feed is about 100 to 5000 $Nm^3/m^3$.

18. The process according to claim 1, in which the feed which is treated is a vacuum distillate from vacuum distillation of an atmospheric distillation residue of a crude oil and the vacuum residue is sent to a deasphalting f) from which a deasphalted oil is recovered, at least a portion of which is sent to a), and asphalt is recovered.

19. The process according to claim 18, in which deasphalting is carried out at a temperature of 60° C. to 250° C. with at least one hydrocarbon solvent containing 3 to 7 carbon atoms.

20. The process according to claim 17, in which at least a portion of the slurry fraction obtained in catalytic cracking d) is recycled to the inlet to deasphalting f).

21. The process according to claim 2, in which at least a portion of the liquid fraction which is heavier than the hydrotreated feed obtained in c) is sent to the heavy fuel pool.

22. The process according to claim 1, in which at least part of the gasoline engine fuel fraction and the diesel engine fuel fraction obtained in c) is sent to their respective gasoline pools.

23. A process for hydrotreating a hydrocarbon feed comprising:

treating the hydrocarbon feed in at least one three-phase reactor containing at least one ebullated bed of hydroconversion catalyst;

sending a least a portion of the effluent from at least one three-phase reactor to at least one reactor containing at least one fixed bed of hydrotreatment catalyst;

sending a least a portion of the effluent from at least one reactor containing at least one fixed bed of hydrotreatment catalyst to a distillation zone from which at least a diesel fraction and/or a fraction heavier than the diesel fraction are recovered; and recycling at least a portion of the diesel fraction and/or the fraction heavier than the diesel fraction to at least one three-phase reactor or at least one reactor containing at least one fixed bed of hydrotreatment catalyst.

24. The process for hydrotreating a hydrocarbon feed according to claim 23 further comprising:

subjecting to catalytic cracking at least a portion of the diesel fraction and/or the fraction heavier than the diesel fraction.

25. The process for hydrotreating a hydrocarbon feed according to claim 23 wherein a lighter fraction is recovered from at least one three-phase reactor.

26. The process for hydrotreating a hydrocarbon feed according to claim 25 further comprising:

sending the lighter fraction to the distillation zone.

27. The process for hydrotreating a hydrocarbon feed according to claim 23, wherein the feed has a sulphur content of at least 0.3%, an initial boiling point of at least 300° C., and an end point of at least 400° C.

28. A hydrotreatment process comprising hydrotreating with a fixed bed hydrotreatment catalyst either a liquid fraction from or the entirety of a product from a hydrotreatment of a feed with a three-phase ebullated bed hydrotreatment catalyst.

29. The process for converting a hydrocarbon fraction with a sulphur content of at least 0.3%, an initial boiling point of at least 300° C., and an end point of at least 400° C., comprising:

a) treating the hydrocarbon feed in a treatment section in the presence of hydrogen, said section comprising at least one three-phase reactor, containing at least one ebullated bed of hydroconversion catalyst the mineral support of which is at least partially amorphous, functioning in riser mode for liquid and gas, a line located near the bottom and in communication with the reactor for extracting catalyst from said reactor and a line located near the top and in communication with said reactor for adding fresh catalyst to said reactor;

b) sending at least a portion of the effluent from a) to a section for treatment in the presence of hydrogen, said section comprising at least one reactor containing at least one fixed bed of hydrotreatment catalyst, the mineral support of which is at least partially amorphous, under conditions for producing an effluent with a reduced sulphur content and a higher middle distillates content;

c) sending at least a portion of the effluent obtained from b) to a distillation zone c) wherein a gas fraction, a gasoline engine fuel fraction, a diesel engine fuel fraction and a liquid fraction heavier than the diesel fraction are recovered; and d) sending the liquid fraction heavier than the diesel fraction to a catalytic cracking section wherein the liquid fraction heavier than the diesel fraction is treated under conditions for recovering a gas fraction, a gasoline fraction, a diesel fraction and a slurry fraction.

* * * * *